United States Patent [19]

Edminister et al.

[11] Patent Number: 4,858,530

[45] Date of Patent: Aug. 22, 1989

[54] POWER RELAY/SAFING DEVICE FOR A FUZE SYSTEM

[75] Inventors: Robert E. Edminister, Scottsdale; Raul V. Cavazos, Jr., Phoenix, both of Ariz.

[73] Assignee: Motorola, Inc., Schaumburg, Ill.

[21] Appl. No.: 189,552

[22] Filed: May 2, 1988

[51] Int. Cl.[4] ..... F42C 15/12; F42C 15/40

[52] U.S. Cl. ..... 102/208

[58] Field of Search ..... 102/208, 206

[56] References Cited

U.S. PATENT DOCUMENTS 3,757,695 9/1973 Fisher ..... 102/208

4,031,827 6/1977 Collier ..... 102/208

4,656,943 4/1987 Edminster ..... 102/208

4,715,757 12/1987 Edminster ..... 411/411

*Primary Examiner*—Charles T. Jordan

*Attorney, Agent, or Firm*—Jordan C. Powell

[57] ABSTRACT

A power relay/safing device for a fuze in a free-fall munition having an electronic circuit coupled to the fuze and to a primary power source and to a turbine generator backup power supply. At the time of munition release, an electric current is sent to the fuze from the primary power supply. If a portion of this electric current is not received at the electronic circuit, the circuit determines if various safety features have been satisfied and relays a second electric current from the turbine generator backup power supply to the fuze. The turbine generator backup power supply is activated by a lanyard at the time the munition is released.

34 Claims, 11 Drawing Sheets

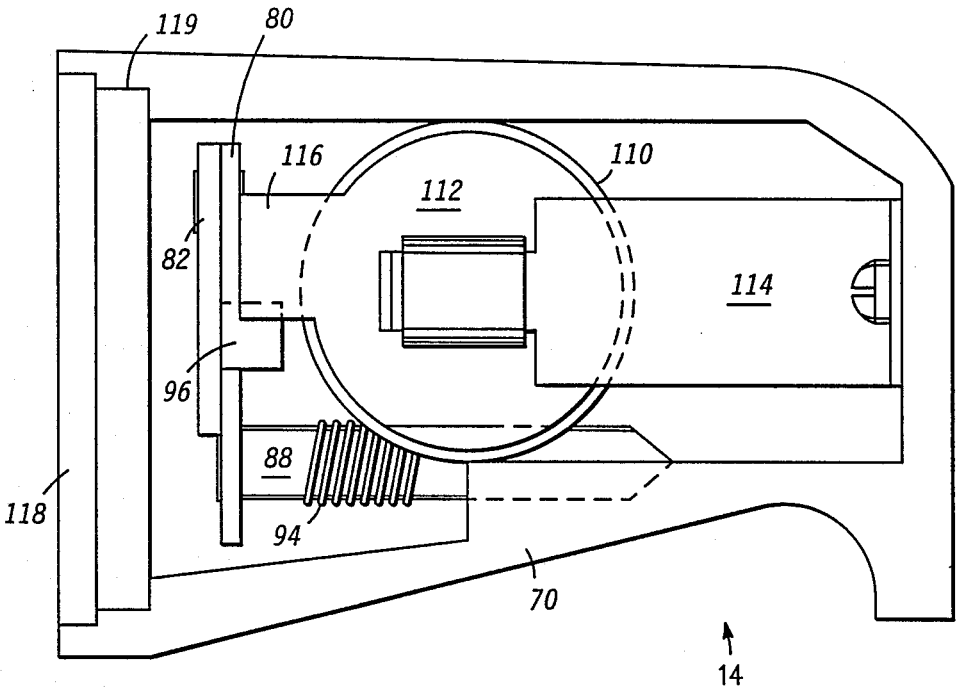
FIG. 8
FIG. 10
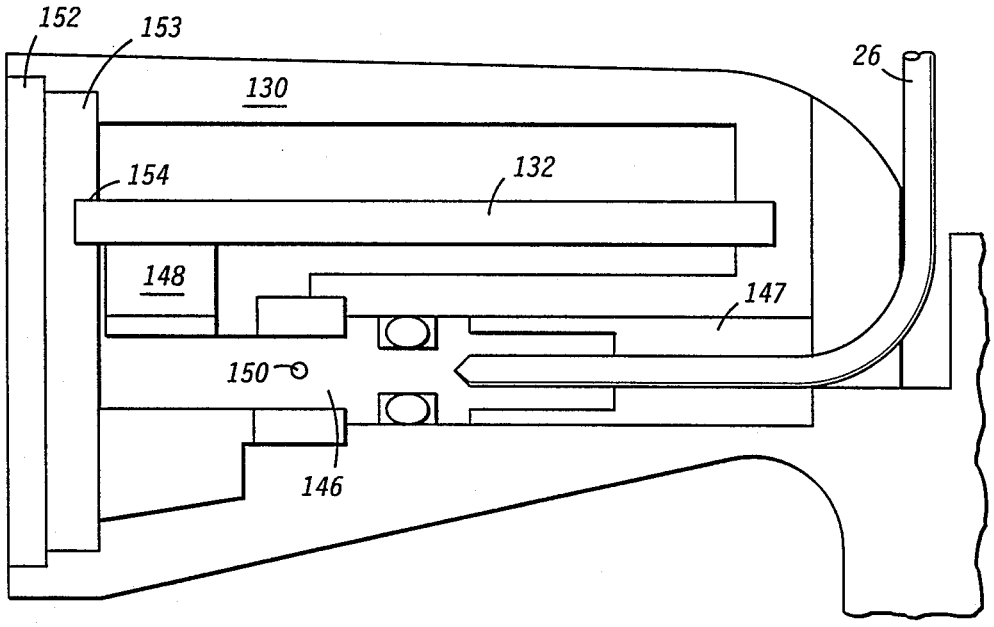

POWER RELAY/SAFING DEVICE FOR A FUZE SYSTEM

BACKGROUND OF THE INVENTION

This invention relates, in general, to fuze systems on free fall munitions, and in particular to power supply devices for such fuze systems.

Electronic fuzes in various free-fall munitions have high reliability of approximately ninety-five percent. These fuzes are powered by turbine generators such as the FZU-48/B, or by an electrical cable connected to a primary power source such as the electrical system of an aircraft. Although the FZU-48/B has a high reliability, it is not compatible with those systems using the electrical cable. The FZU-48/B is the sole source of power for a fuze in a munition using that power system and does not allow for operational parameter selections. The electrical cable system, on the other hand, has a low reliability of down to eighty-two percent. Thus, the high reliability of the fuze is compromised by its connection to the principal power source. The electric cable has continued in use, however, because of its ability to allow an operator to select operational parameters from inside the aircraft. Furthermore, the electrical cable connection incorporates a safety switch system which prevents the fuze from obtaining power while the munition is attached to the aircraft.

SUMMARY OF THE INVENTION

It is, therefore, an object of the present invention to provide a power relay/safing device compatible with the electrical cable system which has a high reliability and does not compromise the reliability of the fuze.

A further object of the present invention is to equip the power relay/safing device with an additional power source to be used as a backup on the electrical cable systems to provide the increased reliability.

Still another object of the invention is to ensure that the power relay/safing device remains capable of operational parameters selection.

To achieve these objects and advantages, a power relay/safing device is contemplated which is designed compatible with the space constraints of the prior art electrical cable connector. One embodiment of the invention would use an electrical cable coupling the primary power source of the aircraft to an integrated circuit (IC) control circuit with the power relay/safing device. The control circuit is also coupled to a backup power supply such as a turbine generator. An output of the IC control circuit couples these power sources to the fuze. The power relay/safing device incorporates several safety devices and switches including shear pins, a transducer, and a radiation hazard guard. When the device is operationally coupled to a munition which is being released, an electric current is sent from the primary power source to the control circuit at approximately the same time as the turbine generator is exposed to the air current flowing past the munition. At the same time the radiation hazard guard is moved allowing the electrical cable to electrically engage with the control circuit. The control circuit then determines if an electric current from the primary power source was received by the fuze. If not, the control circuit feeds an electric current from the turbine generator to the fuze after evaluating built-in safety features. A timing element of the control circuit ensures that the power connector remains capable of operational parameters selection.

Other objects and advantages of the present invention will become apparent from the following detailed description, particularly when considered in conjunction with the accompanying drawings.

BRIEF DESCRIPTION OF THE DRAWINGS

FIG. 8 is a cutaway side view along line 8—8 of FIG. 6;

FIG. 10 is a cutaway side view along line 10—10 of FIG. 3;

DETAILED DESCRIPTION OF THE PREFERRED EMBODIMENT

The following definitions will help to clarify what various elements are and how they operate in one embodiment of the present invention.

Lanyard—is a cable of a predetermined lenth with means for connecting the cable on each end. The cable is not used for electric current transmission. Preferably, the cable will connect on one end to one element of the power relay/safing device, and on the other end to the munition rack. When the munition falls away from the munition rack at release, the predetermined length of the lanyard operates as a timing mechanism to engage an element of the power relay/safing device at a particular time.

Transducer—is a device that converts mechanical energy into electrical energy.

Umbilical cable—is a power cable, preferably a coaxial cable, which couples the power relay/safing device with a primary power source of the host aircraft.

Within the specification, reference is made to a patented attachment apparatus or locking device. This apparatus, U.S. Pat. No. 4,715,757, issued Dec. 29, 1987, is patented by the same inventor and issued to the same assignee as the present invention, and is incorporated as an element of the preferred embodiment.

Figure 1:
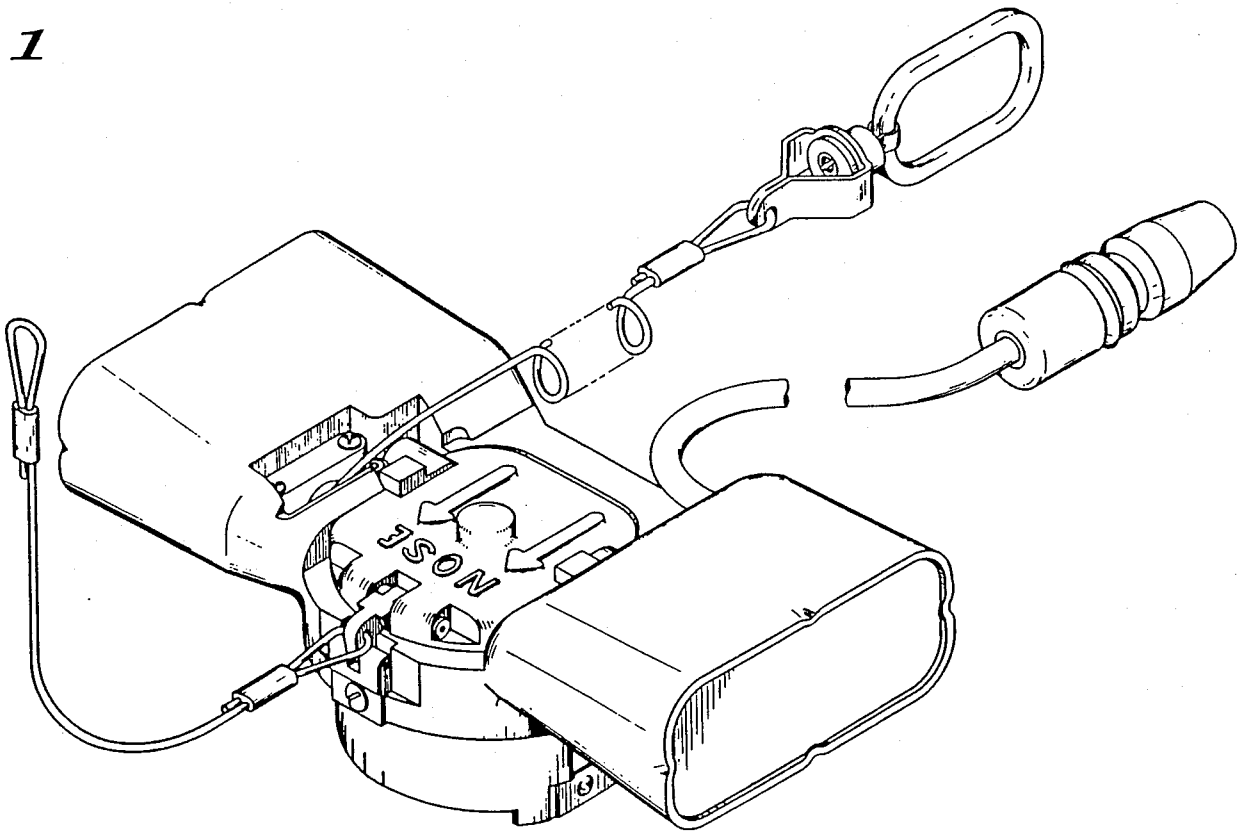
FIG. 1 is an isometric view of the power relay/safing device in accordance with the present invention.
Figure 2:
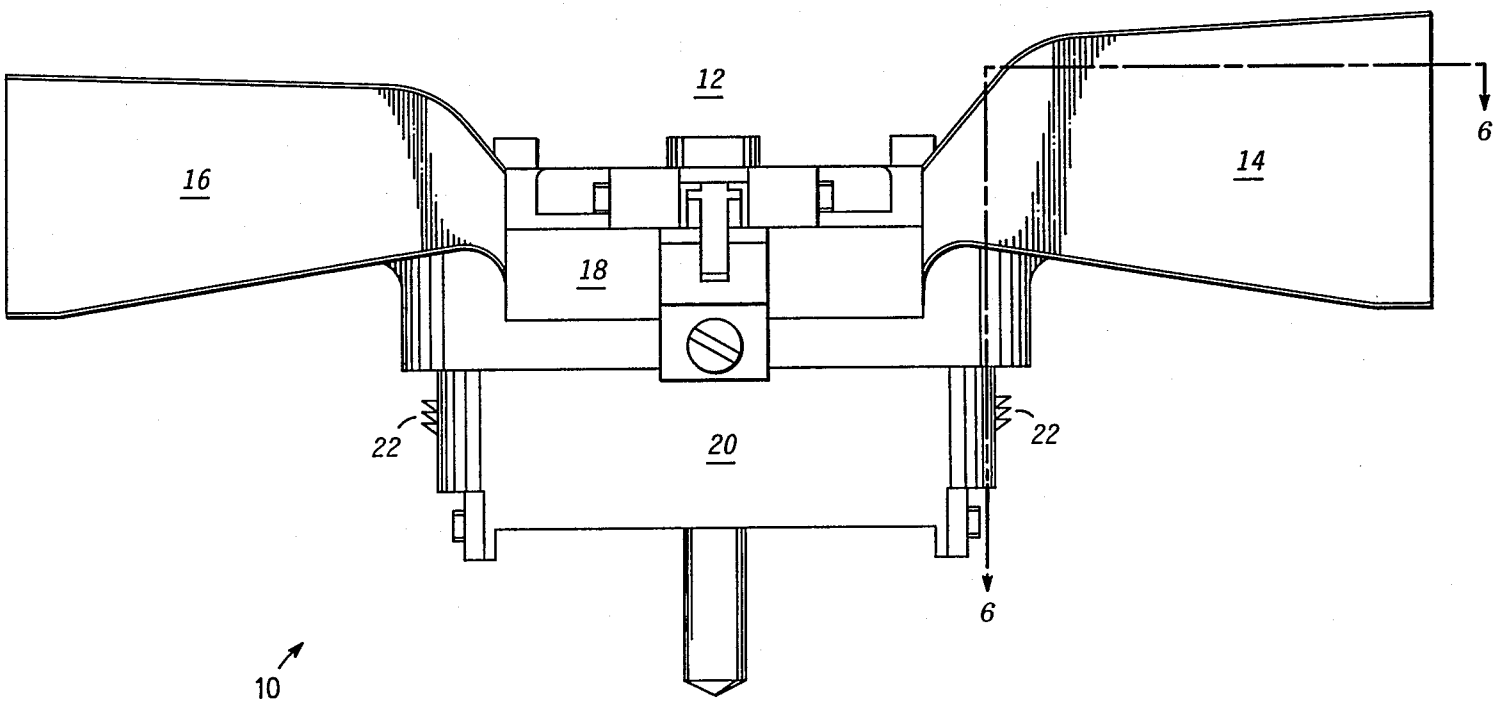
FIG. 2 is a front view of the power relay/safing device.
Figure 11:
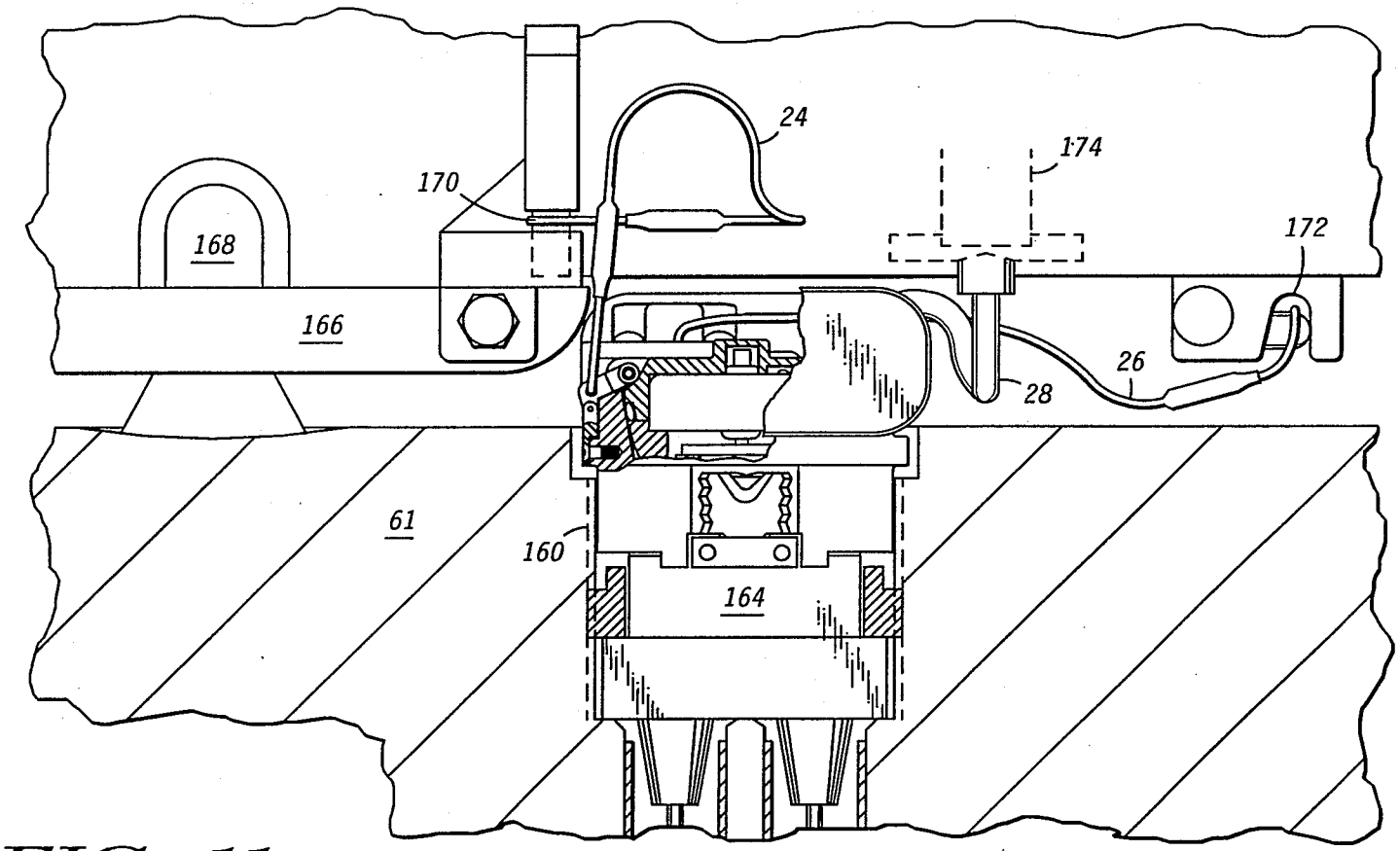
FIG. 11 is a partial cutaway end view of the power relay/safing device when it is operationally coupled to a free-fall munition and munition rack in accordance with the present invention.

In FIGS. 1 and 2, there is shown a power relay/safing device (prsd) 10 having, with respect to a front end 12, a left wing 14, a right wing 16, a center 18, and a base 20. Left wing 14, right wing 16, center 18, and base 20 are, in a preferred embodiment, constructed as one integral piece, but are described throughout the specification as separate pieces for ease of explanation. A plurality of locking mechanisms 22, also shown in FIG. 11, are moveably attached to base 20 in accordance with the above referenced U.S. Pat. No. 4,715,757.

Figure 3:
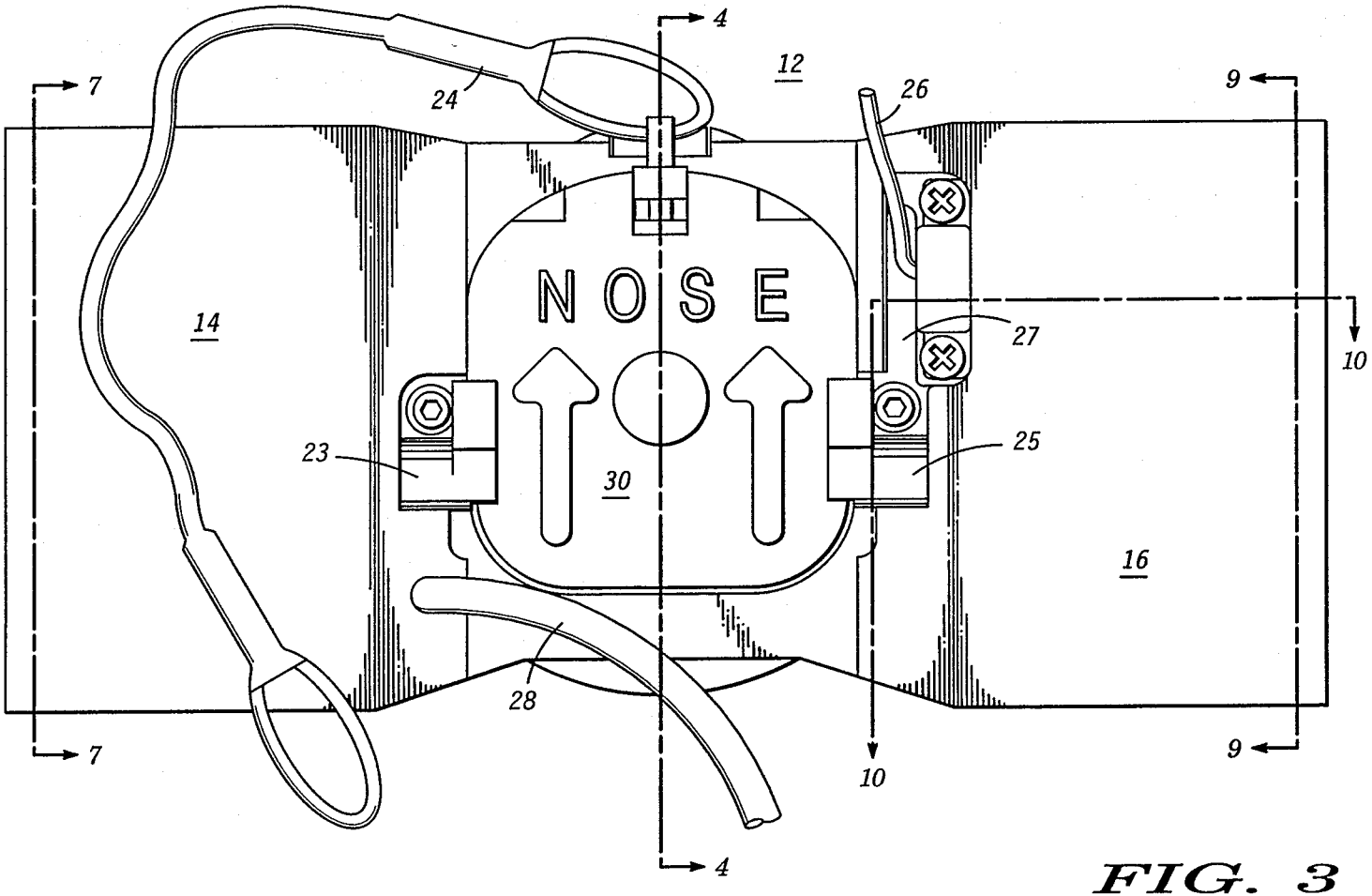
FIG. 3 is a top view of the power relay/safing device.

FIG. 3 shows a top view of prsd 10. In this view, turbine lanyard 24, shorting lanyard 26, and umbilical cable 28 are shown. These elements are explained later in the specification. Also shown in FIG. 3 are turbine generator 30, left hinge 23 rotatably connecting left wing 14 to a left side of turbine generator 30, right hinge 25 rotatably conecting right wing 16 to a right side of turbine generator 30, and lanyard cavity 27.

Figure 4:
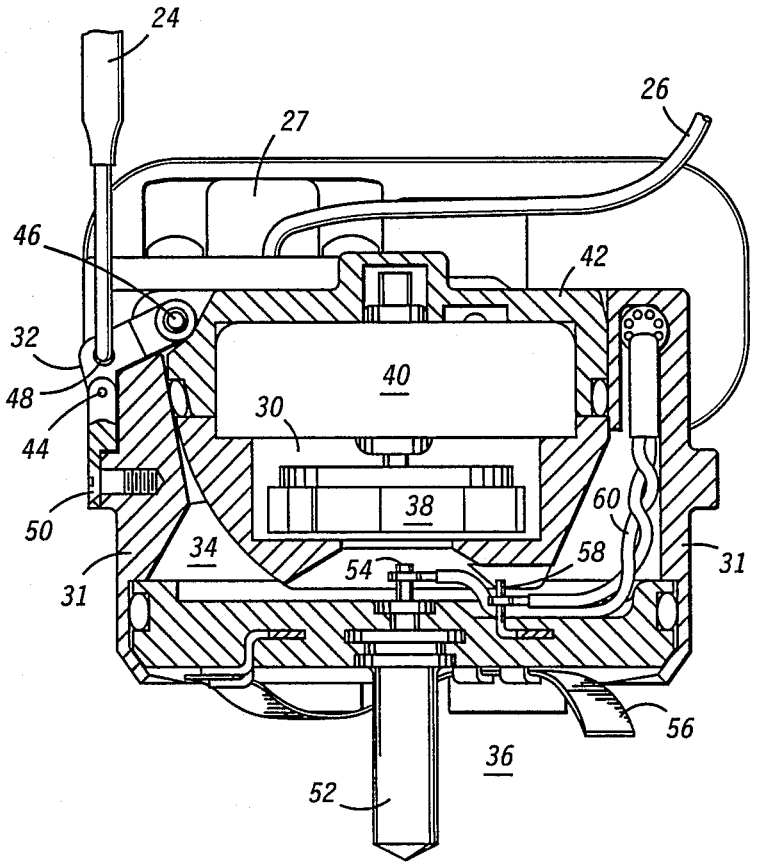
FIG. 4 is a cutaway view along line 4—4 of FIG. 3.

Referring now to FIG. 4, center 18 is illustrated in a cutaway end view along line 4—4 of FIG. 3. Specifically, center 18 comprises turbine generator 30, center housing 31 having a generator cavity 34, safety latch 32, and fuze coupler 36 which couples prsd 10 to the fuze of a munition. Safety latch 32 secures turbine generator 30 in a closed position to center housing 31 such that turbine generator 30 is enclosed within generator cavity 34. Fuze coupler 36 is fixedly secured to a bottom portion of center housing 31. Also shown in FIG. 4 is lanyard cavity 27 of right wing 16 through which shorting lanyard 26 enters right wing 16.

Turbine generator 30 comprises impeller 38, generator element 40 for creating an electric current from the rotating motion of impeller 38, and generator housing 42. Impeller 38 is mechanically coupled to generator element 40.

Safety latch 32 comprises safety shear pin 44, lanyard release shear pin 46 securing safety latch 32 to turbine generator 30, lanyard aperture 48, and latch securing bolt 50 which secures safety latch 32 to center housing 31. Preferably, safety shear pin 44 is designed to shear at approximately 35 pounds of force and lanyard release shear pin 46 is designed to shear at approximately 80 pounds of force. Safety shear pin 44 secures turbine generator 30 in its closed position to center housing 31. One end of turbine lanyard 24 is secured through lanyard aperture 48.

Fuze coupler 36 preferably comprises male connector 52 having post 54, contact ring 56, and contact ring post 58. Post 54 and contact ring post 58 are coupled to electrical output wires 60 of prsd 10. Contact ring 56 and contact ring post 58 are electrically coupled together.

Figure 5:
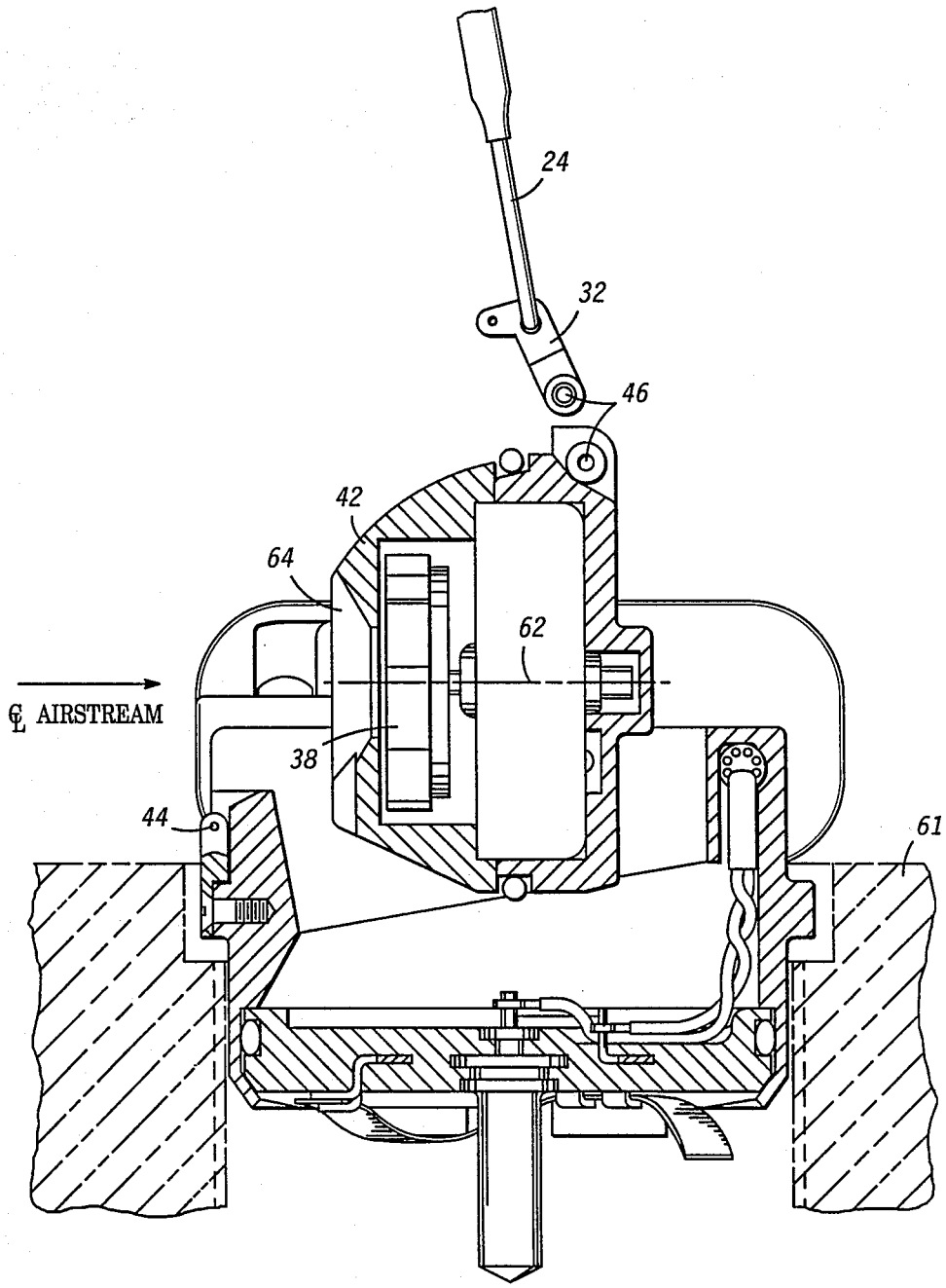
FIG. 5 shows the power relay/safing device in operation as seen along line 4—4 of FIG. 3.

FIG. 5 shows a cutaway end view of prsd 10 along line 4—4 when prsd 10 is operational and is secured to a munition 61. As shown, safety shear pin 44 has been sheared off allowing turbine generator 30 to rotate 90 degrees to a vertical open orientation. A center axis 62 of turbine generator 30 is parallel with munition 61 such that a stream of air flowing around munition 61 enters turbine generator 30 at turbine opening 64 of generator housing 42 and causes impeller 38 to spin at a high velocity. Lanyard release shear pin 46 is shown as having sheared allowing turbine lanyard 24 and safety latch 32 to separate from prsd 10.

Figure 6:
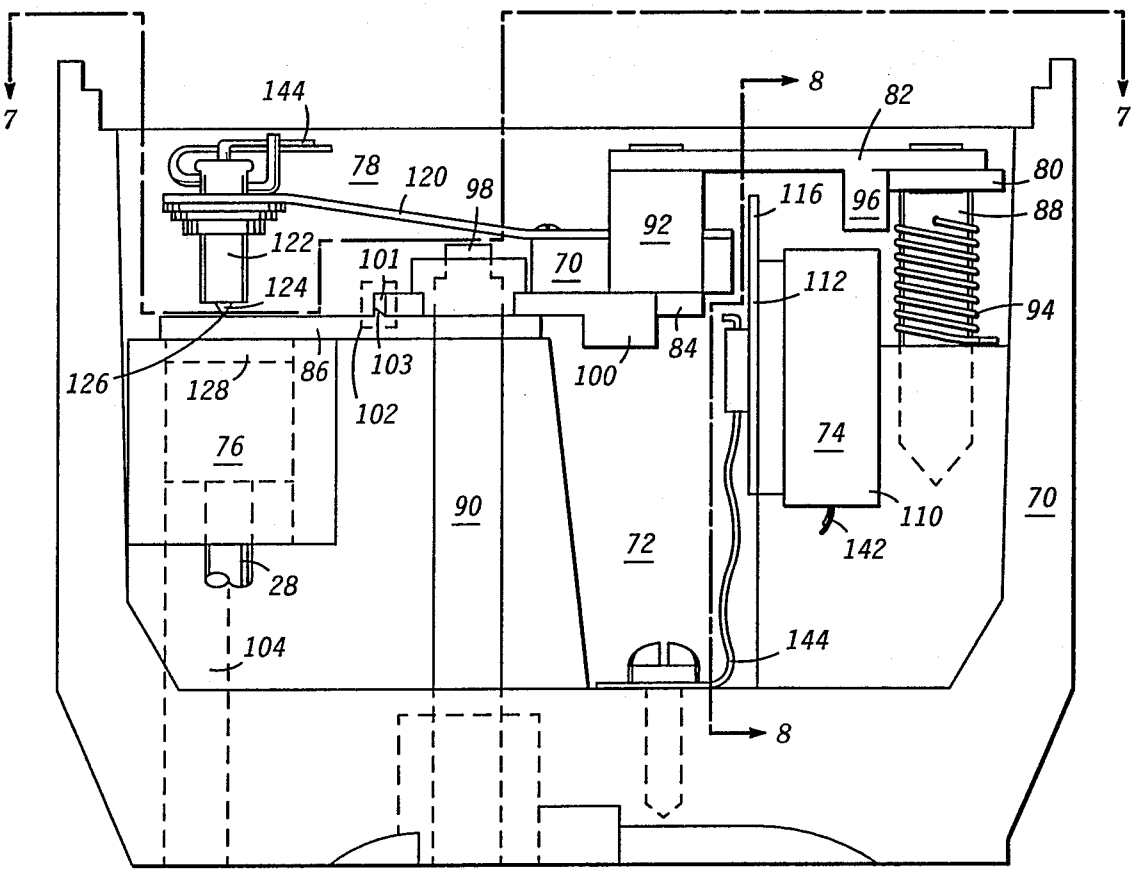
FIG. 6 is a top cutaway view along line 6—6 of FIG. 2.
Figure 7:
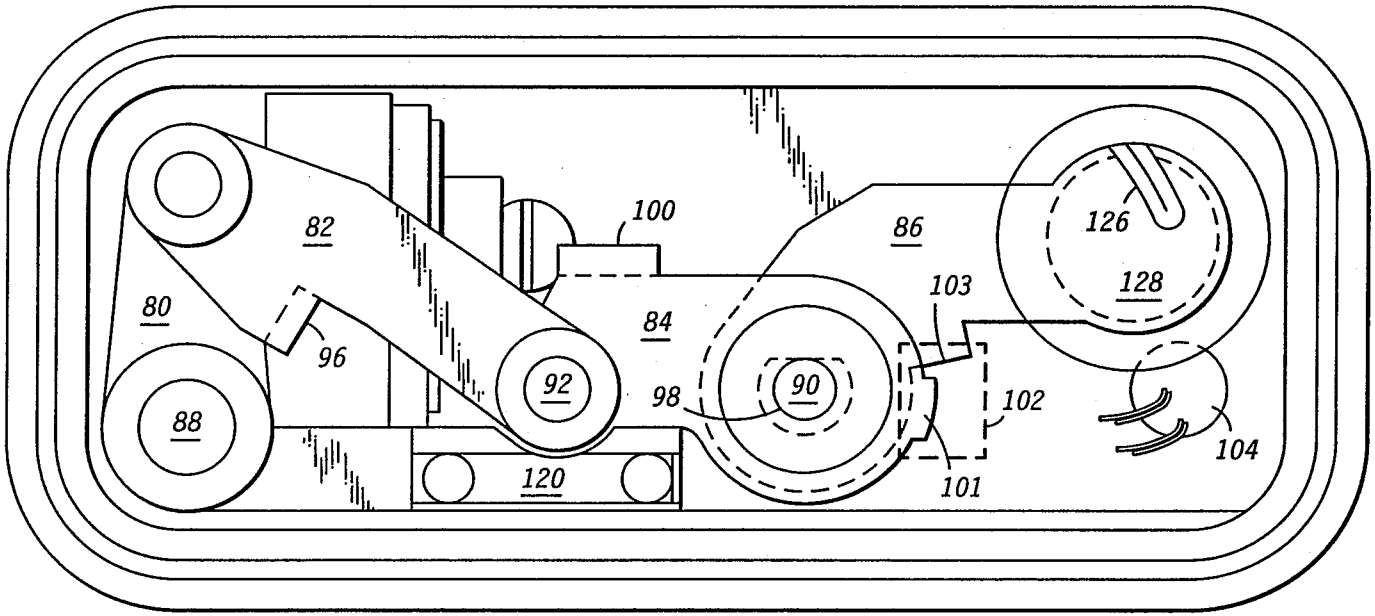
FIG. 7 is an end view along line 7—7 of FIG. 3.

FIG. 6 shows a top cutaway view of left wing 14 along line 6—6 of FIG. 2. Left wing 14 comprises left wing housing 70, mechanical mechanism 72, transducer 74, umbilical receptor 76, and umbilical spring connector 78. Mechanical mechanism 72, also shown in the end view of FIG. 7, comprises spring shaft 88, tension spring 94, first arm 80, second arm 82, rotating hammer arm 84, radiation hazard guard 86, quartered circular shaft 90, and arm connector shaft 92. Spring shaft 88 is mounted in left wing housing 70. First arm 80 is rotatably mounted on spring shaft 88. Spring shaft 88 is coupled to tension spring 94 to impose a torsional force on first arm 80. First arm 80 is securely hinged to one end of second arm 82. Second arm 82 has a protruding portion 96 on the bottom of second arm 82. The other end of second arm 82 is securely hinged to one end of rotating hammer arm 84 by arm connector shaft 92. The other end of rotating hammer arm 84 is fixedly secured about mechanism end 98 of quartered circular shaft 90. An opposite end of quartered circular shaft 90 is fixedly secured to left hinge 23 of prsd 10 such that quartered circular shaft 90 rotates when turbine generator 30 opens.

Radiation hazard guard 86 has one end rotatably secured about mechanism end 98 of quartered circular shaft 90 such that radiation hazard guard 86 does not necessarily rotate with quartered circular shaft 90. Rotating hammer arm 84 includes hammer 100 oriented such that as rotating hammer arm 84 is rotated, hammer 100 contacts radiation hazard guard 86 causing it to rotate about quartered circular shaft 90. Rotating hammer arm 84 and radiation hazard guard 86 comprise safety catch 102 for preventing radiation hazard guard 86 from rotating prematurely. Safety catch 102 includes hammer arm ledge 101 of rotating hammer arm 84 and guard catch 103 of radiation hazard guard 86. Left wing 14 further comprises left wing wire aperture 104 which extends to generator cavity 34.

Mechanical mechanism 72 operates as an over-center device. Therefore, if turbine generator 30 has rotated up to approximately 30 degrees open, mechanical mechanism 72 will act as a spring to try to rotate turbine generator back closed. When a force is applied which opens turbine generator 30 more than 30 degrees, mechanical mechanism 72 operates to further rotate turbine generator 30 to its open position and lock it in position. The slightly longitudinal orientation of second arm 82 with respect to the vertical orientation of first arm 80 operates to force turbine generator 30 open.

FIG. 8 shows transducer 74 in a cutaway view along line 8—8 of FIG. 6. Transducer 74, also shown in FIG. 6, comprises transducer apparatus 110 for converting mechanical energy into electric energy, slapper 112 for striking transducer apparatus 110, transducer spring 114 fixedly attached on one end to slapper 112 and on an opposite end to left wing housing 70 for removably binding slapper 112 to transducer apparatus 110. Slapper 112 has elongated end 116 on one end. Transducer 74 is fixedly secured to left wing housing 70. In operation, slapper 112 is pulled away from transducer apparatus 110, but then "slapped" back against transducer apparatus 110 by transducer spring 114. The mechanical energy created by slapper 112 converts into electrical energy by cutting through the transducer lines of magnetic flux. The electrical energy created is stored in electronic circuit 132 as explained subsequently.

Umbilical spring connector 78, shown in FIG. 6, comprises connector spring 120 connected on one end to left wing housing 70, umbilical connector 122 fixedly coupled to an opposite end of connector spring 120, umbilical wires 144, and connector tip 124 of umbilical connector 122. Connector tip 124 inserts into tip groove 126 of radiation hazard guard 86, shown in FIG. 7, when radiation hazard guard 86 covers receptor opening 128 of umbilical receptor 76. When radiation hazard guard 86 is rotated away from receptor opening 128 by rotating hammer arm 84, connector tip 124 is forced into umbilical receptor 76 by connector spring 120. When connector tip 124 enters umbilical receptor 76, an electric current from a primary power source external to prsd 10 is fed through umbilical cable 28 to umbilical connector 122.

In operation, when turbine generator 30 is rotated to its open position, it causes quartered circular shaft 90 to rotate. As quartered circular shaft 90 rotates, it similarly rotates rotating hammer arm 84 about the central axis of shaft 90. Rotation of hammer arm 84 creates a longitudinal and upward motion in second arm 82 and a circular rotation in first arm 80. As second arm 82 moves longitudinally, it passes protruding portion 96 past transducer apparatus 110. Protruding portion 96 then catches elongated end 116 of slapper 112 and pulls slapper 112 away from the body of transducer apparatus 110. Protruding portion 96 and elongated end 116 are designed such that after slapper 112 has pulled a small distance away from transducer apparatus 110, elongated end 116 slips away from protruding portion 96 and slapper 112 "slaps" back onto transducer apparatus 110. At approximately the same time, hammer 100 of rotating hammer arm 84 contacts and pushes radiation hazard guard 86 away from receptor opening 128. This allows umbilical connector 122 to slip past radiation hazard guard 86 and electrically contact umbilical receptor 76.

Left cover 118 and left housing aperture 119 are shown in FIG. 8. In a preferred embodiment, left cover 118 is coupled to left wing housing 70 by crimping the end edges of left housing 70 after left cover 118 is inserted into left housing aperture 119. Left cover 118 is shown crimped into place in FIG. 1.

Figure 9:
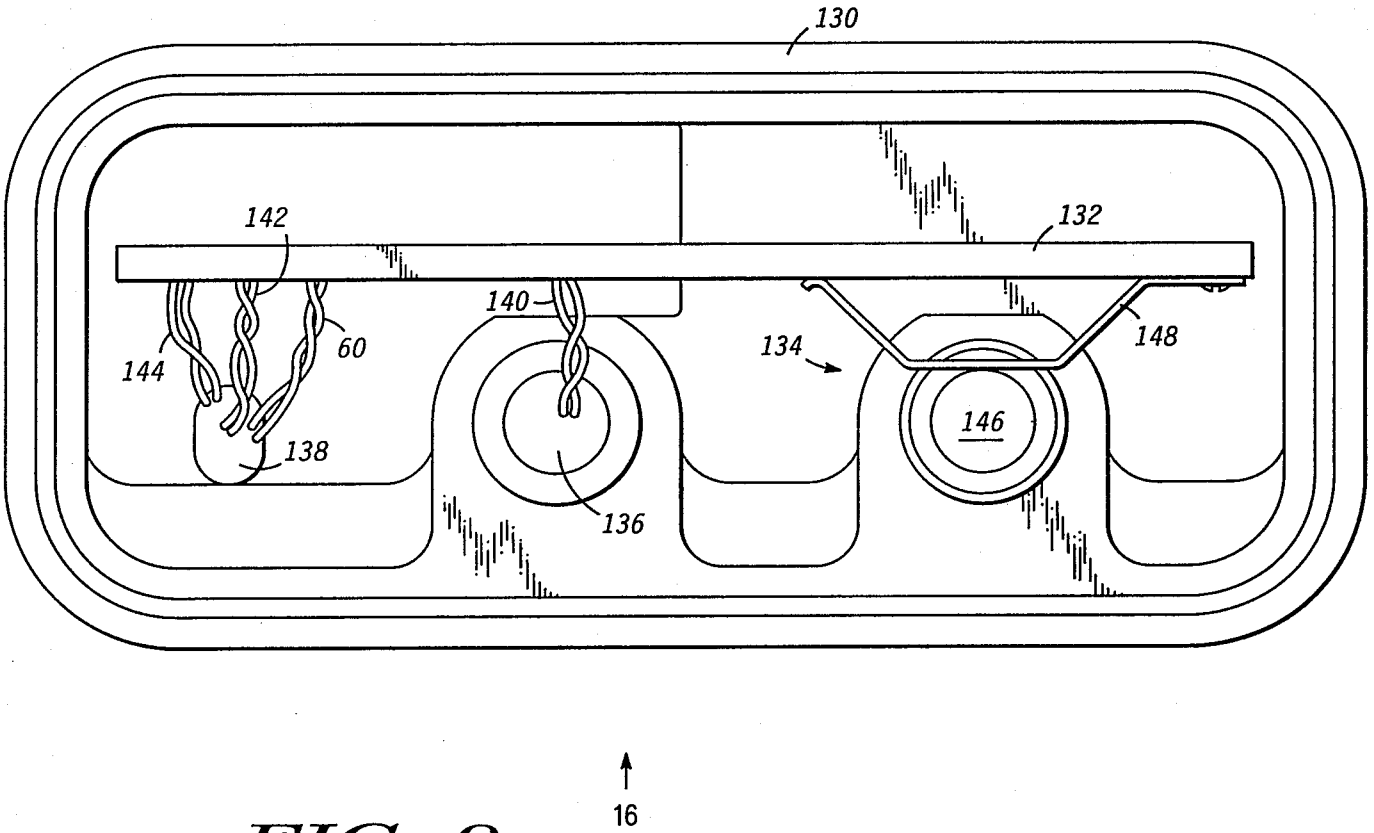
FIG. 9 is an end view along line 9—9 of FIG. 3.

FIG. 9 shows an end view of rightwing 16 along line 9—9 of FIG. 3. Right wing 16 comprises right wing housing 130, electronic circuit 132 and shorting means 134. Electronic circuit 132 determines when power is received from the primary power source through umbilical connector 28, determines if the munition may be safely armed, and supplies backup power from turbine generator 30 when power is not received from the primary power source. Shorting apparatus 134 shorts out electric current within electronic circuit 132 until the munition is released and the fuze is to be armed. Electronic circuit 132 is fixedly attached on one edge to right wing housing 130 as shown in FIG. 10. Shorting apparatus 134 is secured on one end to electronic circuit 132, and removably coupled to electronic circuit 132 on an opposite end in a spring loaded fashion. Right wing 16 further comprises generator aperture 136 and right wing wire aperture 138 which extends to generator cavity 34. Generator aperture 136 extends through right wing housing 130 and right hinge 25 to allow generator wires 140 to be inserted therein. Generator wires 140 electrically couple turbine generator 30 to electronic circuit 132. Transducer wires 142 and umbilical wires 144, also shown in FIG. 6, are threaded through right wing wire aperture 138. Transducer wires 142 electrically couple transducer apparatus 110 to electronic circuit 132, and umbilical wires 144 feed electric current from umbilical connector 122 to electronic circuit 132. Electrical output wires 60 couple electronic circuit 132 with fuze coupler 36 and are also threaded through right wing aperture 138.

FIG. 10 shows a detailed view of shorting apparatus 134 along line 10—10 of FIG. 3. As shown in FIG. 10, shorting lanyard 26 is fixedly secured to spring brace 146. Spring brace 146 supports shorting spring 148, further shown in FIG. 9, against electronic circuit 132. When shorting lanyard 26 is pulled, it pulls spring brace 146 into brace sleeve 147 which allows shorting spring 148 to pull away from electronic circuit 132. Shorting shear pin 150 prevents spring brace 146 from being pulled into brace sleeve 147 prematurely. A force of approximately 60 pounds is required to shear shorting shear pin 150 and pull spring brace 146 into brace sleeve 147 in the preferred embodiment.

Right cover 152 and right housing aperture 153 are shown in FIG. 10. As with left cover 118, right cover 152 is inserted into right housing aperture 153 and coupled to right wing housing 130 by crimping the end edges of right wing housing 130. Right cover 152 includes right cover groove 154 into which one end of electronic circuit 132 is inserted.

FIG. 11 shows prsd 10 fully connected prior to munition release. Prsd 10 is inserted into prsd aperture 160 of munition 61. Post 54 and contact ring 56 of fuze coulper 36 are electrically coupled to fuze end 164 to complete the electrical connection to the fuze of munition 61. Munition 61 is shown supported by munition rack 166 at point 168 and is similarly coupled at other points not shown. Turbine lanyard 24 is shown secured to munition rack 166 at point 170. Shorting lanyard 26 is connected to solenoid 172 of munition rack 166 to selectively allow munition 61 to be released without activating the fuze. Umbilical cable 28 is connected to power supply 174 located within munition rack 166.

Figure 12:
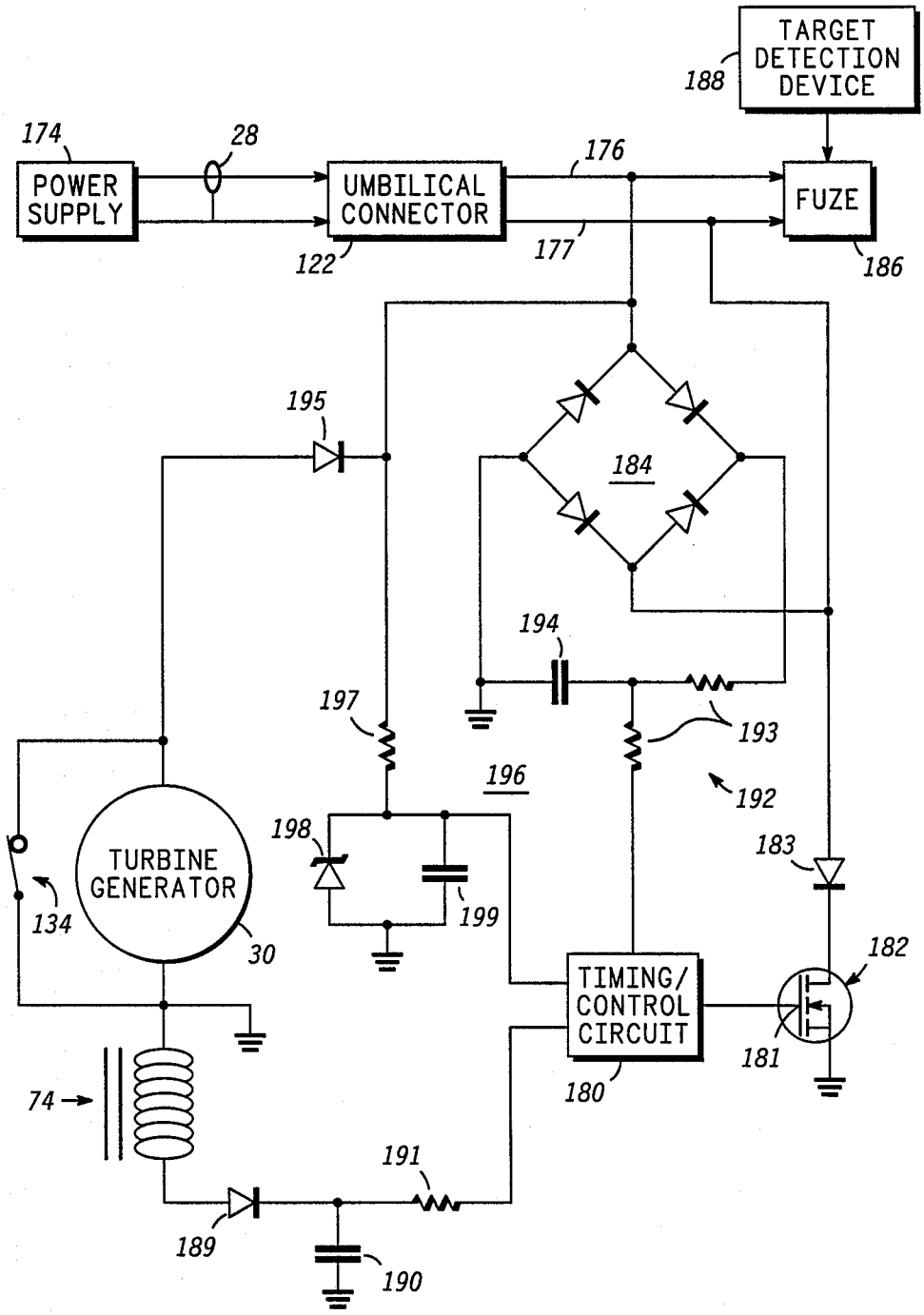
FIG. 12 is a schematic diagram of an electronic circuit of the power relay/safing device.

FIG. 12 shows an electrical schematic diagram of prsd 10. When a current is sent from power source 174, shown as a box in FIG. 12, the current is fed along umbilical cable 28 to umbilical connector 122. Leads 176 and 177 feed the current from umbilical connector 122 to fuze 186 and detection device 188 (IF installed). Leads 176 and 177 are coupled to opposite ends of a bridge 184 which receives a portion of the current from power source 174. Bridge 184 outputs to bridge storage device 192 which stores a portion of the current received from bridge 184. In particular, bridge storage device 192 comprises bridge capacitor 194 which stores the portion of the current and dissipates the current after current is no longer received from power source 174, and resistors 193 which regulate the dissipation rate of the charge stored on bridge capacitor 194. Bridge storage device 192 is constructed in a "T" configuration. Bridge storage device 192 outputs to timing/control circuit 180.

Shorting apparatus 134 is shown in FIG. 12 as having opposite ends coupled to each output of turbine generator 30. Until spring brace 146 is removed by shorting lanyard 24, shorting apparatus 134 will contain current from turbine generator 30 within the loop created by shorting apparatus 134. When spring brace 146 is removed, shorting apparatus 134 is opened and current flows from turbine generator 30 through generator rectifier diode 195 to lead 176. Generator rectifier diode 195 half-wave rectifies the current from generator 30. Part of the rectified current fed through generator rectifier diode 195 is received by voltage regulator/filter 196 as determined by the value of rectifier resistor 197. Voltage regulator/filter 196 maintains a maximum voltage from turbine generator 30 to lead 176 by zener diode 198, and filters the half-wave signal through regulator capacitor 199. Voltage regulator/filter 196 outputs the filtered half-wave signal to timing/control circuit 180.

Transducer 74, when activated by slapper 112, feeds an electrical signal through transducer diode 189 to transducer capacitor 190. The signal from transducer 74 is stored in transducer capacitor 190 for a predetermined time as regulated by transducer resistor 191. In a preferred embodiment, the signal is stored in transducer capacitor 190 for not more then 2 minutes. The energy stored on transducer capacitor is output to timing/control circuit 180.

Timing/control circuit 180 is powered by the rectified current from voltage regulator/filter 196. Timing-/control circuit 180 receives the energy stored in filter capacitor 194 to determine if current was received by bridge 184 from power source 174. If there is no energy stored on filter capacitor 194, timing/control circuit 180 determines if transducer 74 has been activated by receiving the energy stored on transducer capacitor 190. If there is energy still stored on transducer capacitor 190 and no energy on filter capacitor 194, timing/control circuit 180 will induce a voltage on a gate 181 of a field effect transistor (FET) 182, causing conduction within FET 182, or turning FET "on". When FET 182 is "on", it causes an electrical ground at lead 177. FET 182 is coupled to lead 195 through FET diode 183 which restricts current flow to one direction. If there is no energy still stored on transducer capacitor 190, timing circuit will not turn FET 182 "on". When FET 182 is not conducting, no current will flow from turbine generator 30 to fuze 186.

Timing/control circuit 180 further operates to ensure compatibility with operational parameters of fuze 186. At predetermined intervals, timing/control circuit 180 turns FET 182 "on" and "off".

Prsd 10 operates in the following sequential order:

(1) a current is sent from power source 174 to umbilical connector 122;

(2) turbine lanyard 24 shears safety shear pin 44 and pulls turbine generator 30 open, activating turbine generator 30, activating the mechanical components in left wing housing 70, and activating transducer 74;

(3) turbine lanyard 24 is sheared away and umbilical cable 28 breaks away cutting off the current from power source 174;

(4) shorting lanyard 26 pulls spring brace 146 into brace sleave 147 removing the short caused by shorting apparatus 134, and shorting lanyard 26 shears away from munition rack 166; and (5) timing/control circuit 180 determines if current was received from power source 174, and if not, turns FET 182 "on" at the predetermined intervals.

Thus, it is apparent that there has been provided, in accordance with the invention, a power relay/safing device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A power relay/safing device for a fuze in a free-fall munition comprising:

electronic circuit means coupled to the fuze;

power connector means having a first end connected to said electronic circuit means and a second end;

said power connector means for feeding a first electric current from an external power source to said electronic circuit means;

turbine generator means for generating a second electric current;

said turbine generator means having a first output coupled to an electrical ground and a second output coupled to said electronic circuit means; and said electronic circuit means for receiving said first electric current, for receiving said second electric current, for determining if said first electric current was fed through said power connector means, for relaying said first electric current to the fuze, and for feeding said second electric current to the fuze when said first electric current is not received by said electronic circuit means.

2. A power relay/safing device according to claim 1 wherein said power relay/safing device further comprises:

mechanical mechanism means for operating a plurality of safety mechanisms and for locking said turbine generator means into a plurality of positions;

said mechanical mechanism means coupled to said turbine generator;

power receptor means having an open end and an opposite end coupled to said external power source means;

said power receptor means for relaying said first electric current from said external power source means to said power connector means;

housing means for housing said electronic circuit means, said mechanical mechanism means, said power receptor means, said shorting means, said transducer means, and said turbine generator means;

mechanical hinge means fixedly secured to said housing means and rotatably coupled to said turbine generator means; and said mechanical hinge means for rotatably coupling said turbine generator means to said housing means.

3. A power relay/safing device according to claim 2 wherein said power connector means comprises a first lead connector and a second lead connector.

4. A power relay/safing device according to claim 3 wherein said electronic circuit means comprises:

first connector means having one end coupled to said first lead connector and an opposite end coupled to the fuze;

second connector means having one end coupled to said second lead connector and an opposite end coupled to the fuze;

said first connector means and said second connector means for electrically coupling said power connector means and said turbine generator means to the fuze;

bridge storage means having an input coupled to said first and second connector means, and an output;

said bridge storage means for storing a portion of said first electric current;

timing/control circuit means having a first input coupled to said output of said bridge storage means, and an output; and said timing/control circuit means for determining if said portion of said first electric current is stored in said bridge storage means, for causing said second current to be supplied to the fuze, and for determining an output timing of said second electric current to the fuze.

5. A power relay/safing device according to claim 4 wherein said electronic circuit means further comprises:

bridge means for receiving said portion of said first electric current received by said bridge storage means;

said bridge means having a first input coupled to said first connector means, a second input coupled to said second connector means, and an output coupled to said input of said bridge storage means;

voltage regulator/filter means having an input coupled to said output of said turbine generator means, and an output;

said voltage regulator/filter means for limiting a maximum voltage of said second current received at said first connector means, and for receiving and filtering a portion of said second electric current;

field effect transistor (FET) means having a first input coupled to said output of said timing/control circuit means, and a second input; and said FET means for causing said second electric current to be supplied to the fuze.

6. A power relay/safing device according to claim 4 wherein said electronic circuit means is incorporated on a single integrated circuit board.

7. A power relay/safing device according to claim 5 wherein said power relay/safing device further comprises:

transducer means for supplying an electric signal indicating when said second electric circuit may be safely supplied to the fuze; and said transducer means having an output coupled to said electronic circuit means.

8. A power relay/safing device according to claim 4 wherein said bridge storage means comprises:

storage means for storing electric energy for a predetermined temporary time;

resistance means for regulating a dissipation rate of said stored electric energy; and said storage means and said resistance means coupled in a "T" configuration.

9. A power relay/safing device according to claim 5 wherein said voltage regulator/filter means comprises:

resistor means for limiting said portion of said second electric current entering said voltage regulator/filter means;

zener diode means for limiting said maximum voltage;

capacitor means for filtering said portion of second electric current;

said resistor means having an input coupled to said input of said voltage regulator/filter means and an output coupled to said output of said voltage regulator/filter means; and said zener diode means and said capacitor means coupled in parallel to said output of said resistor means.

10. A power relay/safing device according to claim 7 wherein said electronic circuit means further comprises:

transducer storage means for receiving and storing said electric signal from said transducer means;

said transducer storage means having an input coupled to said output of said transducer means, and an output;

said timing/control circuit means further having a third input coupled to said output of said transducer storage means; and said timing/control circuit means further for determining if said electric signal is stored on said transducer storage means.

11. A power relay/safing device according to claim 2 wherein said mechanical mechanism means comprises:

umbilical spring connector means having a first end, and a second end electrically coupled to said electronic circuit means, said umbilical spring connector means mechanically coupled to said housing means by a spring connector means for imposing an axial force along an axis extending from said first end to said second end of said umbilical connector means;

said umbilical spring connector means for engaging said open end of said power receptor means and relaying said first electric current from said power receptor means to said power connector means;

radiation hazard guard means for removeably separating said umbilical connector means and said power receptor means;

hammer arm means for removing said radiation hazard guard means from said open end of said power receptor means, and for activating said locking means;

locking means for applying a downward force on said turbine generator when said turbine generator has rotated less than a predetermined distance, and for locking said turbine generator in an upright position when said turbine generator has rotated more than said predetermined distance; and said hammer arm means operationally coupled to said turbine generator means, said hammer arm means having a first end rotatably coupled to said radiation hazard guard means and a second end rotatably coupled to said locking means.

12. A power relay/safing device according to claim 11 wherein said locking mechanism comprises:

over-center device means for locking said turbine generator in said upright position after said turbine generator has rotated more than said predetermined distance;

spring means for inducing said downward force on said turbine generator when said turbine generator has not rotated more than said predetermined distance;

said spring means having a first end rotatably coupled to said housing means and a second end; and said over-center device having a first end rotatably coupled to said second end of said hammer arm, and a second end rotatably coupled to said second end of said spring means.

13. A power relay/safing device according to claim 11 wherein said power relay/safing device further comprises:

transducer means for supplying an electric signal indicating when said second electric circuit may be safely supplied to the fuze; and said transducer means fixedly secured to said housing means and electrically coupled to said electronic circuit means.

14. A power relay/safing device according to claim 13 wherein said transducer means comprises:

transducer apparatus means;

slapper means;

said slapper means for cutting through lines of magnetic flux;

said transducer apparatus means for creating an electric signal as said slapper means cuts through said lines of magnetic flux; and transducer spring means for removably binding said slapper means to said transducer apparatus means.

15. A power relay/safing device according to claim 14 wherein said locking means engages and activates said slapper means.

16. A power relay/safing device according to claim 1 wherein said power relay/safing device further comprises:

shorting means for removeably shorting said second electric current;

said shorting means having a first end coupled to said output of said turbine generator and a second end coupled to a second output of said turbine generator, and a mechanically removeable switch means coupled between said first end and said second end of said shorting means;

said mechanically removeable switch means for removing said shorting means from said turbine generator;

transducer means for supplying an electric signal indicating when said second electric circuit may be safely supplied to the fuze; and said transducer means having a first output coupled to said electrical ground and a second output coupled to said electronic circuit means.

17. A power relay/safing device according to claim 16 wherein said transducer means comprises:

transducer apparatus means;

slapper means;

said slapper means for cutting through lines of magnetic flux;

said transducer apparatus means for creating an electric signal as said slapper means cuts through said lines of magnetic flux; and transducer spring means for removably binding said slapper means to said transducer apparatus means.

18. A power relay/safing device according to claim 17 wherein said power relay/safing device further comprises:

first mechanical hinge means;

second mechanical hinge means;

said first mechanical hinge means and said second mechanical hinge means fixedly coupled to opposite sides of said turbine generator means;

said first mechanical hinge means and said second mechanical hinge means for allowing rotation of said turbine generator means with respect to an axis extending through said first mechanical hinge means and said second mechanical hinge means;

mechanical mechanism means for operating a plurality of safety mechanisms and for locking said turbine generator means into a plurality of positions;

said mechanical mechanism coupled to said turbine generator through said first mechanical hinge means;

power receptor means having an open end and an opposite end coupled to a first end of an umbilical connector means;

said umbilical connector means having a second end coupled to said external power source means;

said umbilical connector means for electrically coupling said external power source means to said power receptor means;

said power receptor means for relaying said first electric current from said external power source means to said power connector means;

housing means for housing said electronic circuit means, said mechanical mechanism means, said power receptor means, said shorting means, said transducer means, and said turbine generator means; and said first mechanical hinge means and said second mechanical hinge means rotatably coupling said turbine generator means to said housing means.

19. A power relay/safing device according to claim 18 wherein said power connector means comprises a first lead connector and a second lead connector.

20. A power relay/safing device according to claim 19 wherein said electronic circuit means comprises:

first connector means having one end coupled to said first lead connector and an opposite end coupled to the fuze;

second connector means having one end coupled to said second lead connector and an opposite end coupled to the fuze;

said first connector means and said second connector means for electrically coupling said power connector means and said turbine generator means to the fuze;

bridge means for receiving a portion of said first electric current;

said bridge means having a first input coupled to said first connector means, a second input coupled to said second connector means, and a output;

bridge storage means having an input coupled to said output of said bridge means, a first output, and a second output coupled to said electrical ground;

said bridge storage means for storing said portion of said first electric current;

generator rectifier means having an input coupled to said second output of said turbine generator means, a first output coupled to said first connector means, and a second output;

said generator rectifier means for half-wave rectifying said second electric current and allowing current flow in only one direction;

voltage regulator/filter means having an input coupled to said second output of said generator rectifier means, a first output coupled to said electrical ground, and a second output;

said voltage regulator/filter means for limiting a maximum voltage of said second current received at said first connector means, and for receiving and filtering a portion of said second electric current;

transducer diode means having an input coupled to said second output of said transducer means and an output;

said transducer diode means for allowing current flow in only one direction;

signal storage means having an input coupled to said output of said transducer diode means, a first output coupled to said electrical ground, and a second output;

said signal storage means for temporarily storing said electric signal from said transducer means;

timing/control circuit means having a first input coupled to said first output of said bridge storage means, a second input coupled to said second output of said voltage regulator/filter means, a third input coupled to said second output of said signal storage means, and an output;

field effect transistor (FET) means having a first input coupled to said output of said timing/control circuit means, a second input, and an output coupled to said electrical ground;

said timing/control circuit means for determining if said portion of said first electric current is stored in said bridge storage means, for determining if said electric signal is stored in said signal storage means, for activating said FET means, and for determining an output timing of said second electric current to the fuze;

FET diode means having an input coupled to said second connector means and an output coupled to said second input of said FET;

said FET diode means for allowing current flow in only one direction; and said FET means for causing said second electric current to be supplied to the fuze.

21. A power relay/safing device according to claim 20 wherein said electronic circuit means is incorporated on a single integrated circuit board.

22. A power relay/safing device according to claim 18 wherein said mechanical mechanism means comprises:

quartered shaft means having a first end coupled to said turbine generator means through said first mechanical hinge means, and a second end;

umbilical spring connector means having:

a first end electrically coupled to said second end of said power connector means, a second end, connector spring means having a first end fixedly secured to said first end of said umbilical connector means and a second end fixedly secured to said housing means, said connector spring means for imposing an axial force along an axis extending from said first end to said second end of said umbilical connector means;

said umbilical spring connector means for engaging said open end of said power receptor means and relaying said first electric current from said power receptor means to said power connector means;

radiation hazard guard means having a first end removeably covering said open end of said power receptor means and a second end rotatably coupled to said second end of said quartered shaft means;

said radiation hazard guard means for removeably separating said umbilical connector means and said power receptor means;

hammer arm means having a first end fixedly coupled to said second end of said quartered shaft means, and a second end;

locking means having a first end rotatably coupled to said second end of said hammer arm means, and a second end rotatably secured to said housing means;

said quartered shaft means for rotating said hammer arm means when said turbine generator means rotates open;

said hammer arm means for removing said radiation hazard guard means from said open end of said power receptor means, and for activating said locking means;

said locking means for applying a downward force on said turbine generator when said turbine generator has rotated less than a predetermined distance, for locking said turbine generator in an upright position when said turbine generator has rotated more than said predetermined distance, and for engaging and activating said slapper means.

23. A power relay/safing device according to claim 22 wherein said locking mechanism comprises:

over-center device means for locking said turbine generator in said upright position after said turbine generator has rotated more than said predetermined distance;

spring means for inducing said downward force on said turbine generator when said turbine generator has not rotated more than said predetermined distance;

said spring means having a first end rotatably coupled to said housing means and a second end; and said over-center device having a first end rotatably coupled to said second end of said hammer arm, and a second end rotatably coupled to said second end of said spring means.

24. A power relay/safing device according to claim 21 wherein said bridge storage means comprises:

storage means for storing electric energy for a predetermined temporary time;

resistance means for regulating a dissipation rate of said stored electric energy; and said storage means and said resistance means coupled in a "T" configuration.

25. A power relay/safing device according to claim 21 wherein said voltage regulator/filter means comprises:

resistor means for limiting said portion of said second electric current entering said voltage regulator/filter means;

zener diode means for limiting said maximum voltage;

capacitor means for filtering said portion of second electric current;

said resistor means having an input coupled to said input of said voltage regulator/filter means and an output coupled to said output of said voltage regulator/filter means; and said zener diode means and said capacitor means coupled in parallel to said output of said resistor means.

26. A power relay/safing device for a fuze in a free-fall munition comprising:

electronic circuit means coupled to the fuze;

power connector means having a first end connected to said electric circuit means and a second end;

said power connector means for feeding a first electric current from an external power source to said electronic circuit means;

turbine generator means for generating a second electric current;

said turbine generator means having a first output coupled to an electrical ground and a second output coupled to said electronic circuit means;

said electronic circuit means for receiving said first electric current, for receiving said second electric current, for determining if said first electric current was fed through said power connector means, for relaying said first electric current to the fuze, and for feeding said second electric current to the fuze when said first electric current is not received by said electronic circuit means;

shorting means for removeably shorting said second electric current;

said shorting means having a first end coupled to said first output of said turbine generator and a second end coupled to said second output of said turbine generator, and a mechanically removeable switch means coupled between said first end and said second end of said shorting means;

said mechanically removeable switch means for removing said shorting means from said turbine generator;

transducer means for supplying an electric signal indicating when said second electric circuit may be safely supplied to the fuze;

said transducer means having a first output coupled to said electrical ground and a second output coupled to said electronic circuit means;

first mechanical hinge means;

second mechanical hinge means;

said first mechanical hinge means and said second mechanical hinge means fixedly coupled to opposite sides of said turbine generator means;

said first mechanical hinge means and said second mechanical hinge means for allowing rotation of said turbine generator means with respect to an axis extending through said first mechanical hinge means and said second mechanical hinge means;

mechanical mechanism means for operating a plurality of safety mechanisms and for locking said turbine generator means into a plurality of positions;

said mechanical mechanism coupled to said turbine generator through said first mechanical hinge means;

power receptor means having an open end and an opposite end coupled to a first end of an umbilical connector means;

said umbilical connector means having a second end coupled to said external power source means;

said umbilical connector means for electrically coupling said external power source means to said power receptor means;

said power receptor means for relaying said first electric current from said external power source means to said power connector means;

housing means for housing said electronic circuit means, said mechanical mechanism means, said power receptor means, said shorting means, said transducer means, and said turbine generator means; and said first mechanical hinge means and said second mechanical hinge means rotatably coupling said turbine generator means to said housing means.

27. A power relay/safing device according to claim 26 wherein said transducer means comprises:

transducer apparatus means;

slapper means;

said slapper means for cutting through lines of magnetic flux;

said transducer apparatus means for creating an electric signal as said slapper means cuts through said lines of magnetic flux; and transducer spring means for removably binding said slapper means to said transducer apparatus means.

28. A power relay/safing device according to claim 26 wherein said power connector means comprises a first lead connector and a second lead connector.

29. A power relay/safing device according to claim 28 wherein said electronic circuit means comprises:

first connector means having one end coupled to said first lead connector and an opposite end coupled to the fuze;

second connector means having one end coupled to said second lead connector and an opposite end coupled to the fuze;

said first connector means and said second connector means for electrically coupling said power connector means and said turbine generator means to the fuze;

bridge means for receiving a portion of said first electric current;

said bridge means having a first input coupled to said first connector means, a second input coupled to said second connector means, and an output;

bridge storage means having an input coupled to said output of said bridge means, a first output, and a second output coupled to said electrical ground;

said bridge storage means for storing said portion of said first electric current;

generator rectifier means having an input coupled to said second output of said turbine generator means, a first output coupled to said first connector means, and a second output;

said generator rectifier means for half-wave rectifying said second electric current and allowing current flow in only one direction;

voltage regulator/filter means having an input coupled to said second output of said generator rectifier means, a first output coupled to said electrical ground, and a second output;

said voltage regulator/filter means for limiting a maximum voltage of said second current received at said first connector means, and for receiving and filtering a portion of said second electric current;

transducer diode means having an input coupled to said second output of said transducer means and an output;

said transducer diode means for allowing current flow in only one direction;

signal storage means having an input coupled to said output of said transducer diode means, a first output coupled to said electrical ground, and a second output;

said signal storage means for temporarily storing said electric signal from said transducer means;

timing/control circuit means having a first input coupled to said first output of said bridge storage means, a second input coupled to said second output of said voltage regulator/filter means, a third input coupled to said second output of said signal storage means, and an output;

field effect transistor (FET) means having a first input coupled to said output of said timing/control circuit means, a second input, and an output coupled to said electrical ground;

said timing/control circuit means for determining if said portion of said first electric current is stored in said bridge storage means, for determining if said electric signal is stored in said signal storage means, for activating said FET means, and for determining an output timing of said second electric current to the fuze;

FET diode means having an input coupled to said second connector means and an output coupled to said second input of said FET;

said FET diode means for allowing current flow in only one direction; and said FET means for causing said second electric current to be supplied to the fuze.

30. A power relay/safing device according to claim 27 wherein said mechanical mechanism means comprises:

quartered shaft means having a first end coupled to said turbine generator means through said first mechanical hinge means, and a second end;

umbilical spring connector means having:

a first end electrically coupled to said second end of said power connector means, a second end, connector spring means having a first end fixedly secured to said first end of said umbilical connector means and a second end fixedly secured to said housing means, said connector spring means for imposing an axial force along an axis extending from said first end to said second end of said umbilical connector means;

said umbilical spring connector means for engaging said open end of said power receptor means and relaying said first electric current from said power receptor means to said power connector means;

radiation hazard guard means having a first end removeably covering said open end of said power receptor means and a second end rotatably coupled to said second end of said quartered shaft means;

said radiation hazard guard means for removeably separating said umbilical connector means and said power receptor means;

hammer arm means having a first end fixedly coupled to said second end of said quartered shaft means, and a second end;

locking means having a first end rotatably coupled to said second end of said hammer arm means, and a second end rotatably secured to said housing means;

said quartered shaft means for rotating said hammer arm means when said turbine generator means rotates open;

said hammer arm means for removing said radiation hazard guard means from said open end of said power receptor means, and for activating said locking means;

said locking means for applying a downward force on said turbine generator when said turbine generator has rotated less than a predetermined distance, for locking said turbine generator in an upright position when said turbine generator has rotated more than said predetermined distance, and for engaging and activating said slapper means.

31. A power relay/safing device according to claim 30 wherein said locking mechanism comprises:

over-center device means for locking said turbine generator in said upright position after said turbine generator has rotated more than said predetermined distance;

spring means for inducing said downward force on said turbine generator when said turbine generator has not rotated more than said predetermined distance;

said spring means having a first end rotatably coupled to said housing means and a second end; and said over-center device having a first end rotatably coupled to said second end of said hammer arm, and a second end rotatably coupled to said second end of said spring means.

32. A method for determining when a backup power supply is needed for a fuze of a free-fall munition, and supplying the backup power, said method comprising the steps of:

coupling the fuze to an electronic circuit;

coupling said electronic circuit to a primary power source and a backup power source;

supplying a first electric current from said primary power source to the fuze via said electronic circuit when the munition is released;

determining if said first electric current is received by said electronic circuit from said primary power source; and supplying a second electric current from said backup power source when said first electric current is not received by said electronic circuit.

33. A method according to claim 32 wherein said determining if said first electric current is received by said electronic circuit comprises the steps of:

storing a portion of said first electric current in a capacitor of said electronic circuit;

dissipating said stored portion of said first electric current from said capacitor after said first electric current is no longer received by said electronic circuit;

receiving said dissipated portion in a timing/control circuit of said electronic circuit; and activating a field effect transistor (FET) of said electronic circuit when said dissipated portion is not received by said timing/control circuit, said FET allowing said second electric current to flow to the fuze when said FET is activated.

34. A method according to claim 33 wherein said supplying a second electric current from said backup power source comprises the steps of:

activating a safe-arm transducer apparatus and storing an electric energy created in said transducer apparatus in a capacitor;

dissipating said stored energy from said capacitor over a predetermined time;

receiving said dissipated stored energy in said timing/control circuit; and activating said FET only when said dissipated stored energy is received by said timing/control circuit.

* * * * *